US005799663A

United States Patent [19]

Gross et al.

[11] Patent Number: 5,799,663

[45] Date of Patent: Sep. 1, 1998

[54] NICOTINE ORAL DELIVERY DEVICE

[75] Inventors: Joseph Gross; John Gerard Kelly, both of Dublin, Ireland

[73] Assignee: Elan Medical Technologies Limited, Athlone, Ireland

[21] Appl. No.: 716,331

[22] PCT Filed: Feb. 17, 1995

[86] PCT No.: PCT/IE95/00019

§ 371 Date: Dec. 23, 1996

§ 102(e) Date: Dec. 23, 1996

[87] PCT Pub. No.: WO95/24135

PCT Pub. Date: Sep. 14, 1995

[30] Foreign Application Priority Data

Mar. 10, 1994 [IE] Ireland ..... 940212

[51] Int. Cl.[6] ..... A24D 47/00

[52] U.S. Cl. ..... 131/270; 131/271; 131/273

[58] Field of Search ..... 131/271, 273, 131/362, 270; 424/440

[56] References Cited

U.S. PATENT DOCUMENTS

| | | | |
|---|---|---|---|
| 3,521,643 | 7/1970 | Toth | 128/201 |
| 4,184,496 | 1/1980 | Adais | 131/271 |
| 4,429,703 | 2/1984 | Haber | 131/273 |
| 5,331,979 | 7/1994 | Henley | 131/273 |
| 5,525,351 | 6/1996 | Dam | 424/440 |

FOREIGN PATENT DOCUMENTS

| | | | |
|---|---|---|---|
| 0 450 253 A1 | 10/1991 | European Pat. Off. | A24F 47/00 |
| 1169637 | 11/1969 | United Kingdom | A61M 15/06 |
| 8801884 | 3/1988 | WIPO | 131/273 |
| WO 93/09687 | 5/1993 | WIPO | A24F 47/00 |

*Primary Examiner*—Vincent Millin
*Assistant Examiner*—V. Srivastava

[57] ABSTRACT

A nicotine oral delivery device, which includes a hollow housing (10) and a hollow mouthpiece (14) which may be detachable connected to the housing (10) or may form with the housing a single piece. The mouthpiece includes a nicotine-containing material (16), in the form of a gel, on one or more of the outer surfaces of the mouthpiece. The housing (10) may also include flavoring (20), such as menthol. The nicotine-containing material (16) may be located as a layer on the mouthpiece (14), or in holes in the mouthpiece or under a permeable membrane (18) covering a portion of the mouthpiece (14). Where the mouthpiece and housing are separate pieces, the mouthpiece may be disposable while the housing reusable.

14 Claims, 3 Drawing Sheets

NICOTINE ORAL DELIVERY DEVICE

DESCRIPTION

1. Technical Field

The present invention relates to means for aiding in the breaking of the cigarette smoking habit and, more particularly, to a device for the oral delivery of nicotine.

2. Background Art

It has been amply established that cigarette smoking is addictive in at least two respects. First, the typical cigarette smoker is chemically addicted to the nicotine contained in the cigarette. In addition, most smokers are also physically addicted to the cigarette as an object of stimulation and manipulation by the lips, and to some extent, the hands.

There is overwhelming evidence linking cigarette smoking to cancer, most significantly, to lung cancer which is believed to be initiated and stimulated by the repeated contact of cigarette smoke with sensitive lung tissue.

Because of the chemical and physical addiction of cigarette smokers, it is typically very difficult, or even impossible, for smoker to kick the habit, even when fully aware of the voluminous and uncontroverted evidence of the highly detrimental effects of continued smoking on their health.

Various means have been proposed and developed to aid smokers who wish to reduce or eliminate the adverse effects of cigarette smoking on their health but who are unable to quit suddenly. One early approach has been the introduction of filters, first as separate units, and later as an integral part of each cigarette, to reduce the amount of smoke which enters the smoker's lungs. However, the use of filters still allows significant amounts of smoke to enter the smoker's lungs and does nothing to reduce the introduction of smoke into the smoker's surroundings from where the smoke can be readily inhaled by persons in the vicinity of the smoker, with proven detrimental effects.

Another approach has been the use of low-nicotine cigarettes designed to reduce the user's dependence on nicotine and thereby facilitate the breaking of the habit. However, here too, smoke is produced and inhaled to the detriment of the smoker and those in his surroundings.

More recently, at least one nicotine-containing gum, sold under the Trademark NICORETTE, has been commercially available. Use of the gum eliminates the highly detrimental cigarette smoke. However, the chewing of gum is, in many circles, considered to be socially unacceptable and could, in addition, interfere with the speech of the user. In addition, use of the gum does nothing to satisfy the user's need to touch and manipulate a cigarette-like object with his lips and hands.

More recently yet, it was proposed to deliver nicotine to the user transcutaneously through the use of, for example, a 24-hour patch which can be attached to the user's upper arm. In contrast with the nicotine-containing gum, use of such a patch avoids the unacceptable chewing and does not interfere with the user's speech. However, like the nicotine-containing gum, use of a nicotine patch does nothing to satisfy the user's need to touch and manipulate a cigarette-like object. Furthermore, the nicotine patch tends to deliver the nicotine uniformly over time, rather than delivering the nicotine in a series of spurts over a relatively limited time, as is the case with the use of cigarettes. An additional disadvantage of the nicotine patch is that it is unsightly, especially in summer, when the users tend to wear short sleeved shirts, blouses or dresses, or no sleeves at all. In fact, it has been noted that sales of such patches drop significantly in the summer.

There is thus a widely recognised need for, and it would be highly advantageous to have, a device for the delivery of nicotine to the user which would satisfy the user's need both for nicotine and for physically manipulating with his lips and hands a cigarette-like device, which device would be able to deliver nicotine to the user at a rate and intensity which is directly controllable by the user.

DISCLOSURE OF INVENTION

According to the present invention there is provided a nicotine oral delivery device, comprising (a) a housing, the housing including a hollow body section and a hollow mouthpiece section connected with the hollow body section; and (b) a nicotine-containing material located on, or in communication with, at least one of the outer surfaces of the mouthpiece section.

According to further features in preferred embodiments of the invention described below, the nicotine-containing material is in the form of a gel which is preferably placed directly on an outside surface of the mouthpiece, or in depressions in a surface of the mouthpiece, or beneath a permeable membrane located on a surface of the mouthpiece.

According to still further features in the described preferred embodiments, the housing includes flavoring, preferably menthol, for imparting a desired flavor to air passing through the housing and into the user's mouth.

According to another embodiment according to the invention there is provided a nicotine oral delivery device, comprising: (a) a hollow housing; (b) a hollow mouth piece detachably connected to the hollow housing; and (c) a nicotine-containing material located on, or in communication with, at least one of the outer surfaces of the mouthpiece. Preferably, the housing is reusable while the mouthpiece is disposable.

The present invention successfully addresses the shortcomings of the presently known configurations by providing an oral nicotine delivery device which delivers nicotine, but not smoke, to the user, at rates which are controllable by the user, and which further satisfies the user's need to manipulate a cigarette-like object with his or her lips and hands.

BRIEF DESCRIPTION OF DRAWINGS

The invention is herein described, by way of example only, with reference to the accompanying drawings, wherein.

The present invention is of an oral nicotine delivery device which can be used to aid cigarette smokers in breaking their habit. Specifically, a device according to the present invention can be used to satisfy a user's chemical addiction to nicotine and physical addiction to the manipulation of a cigarette-like object by the lips and hands, without the inhalation of highly detrimental smoke.

The principles and operation of an oral nicotine delivery device according to the present invention may be better understood with reference to the drawings and the accompanying description.

BEST MODE FOR CARRYING OUT THE INVENTION

Figure 1:
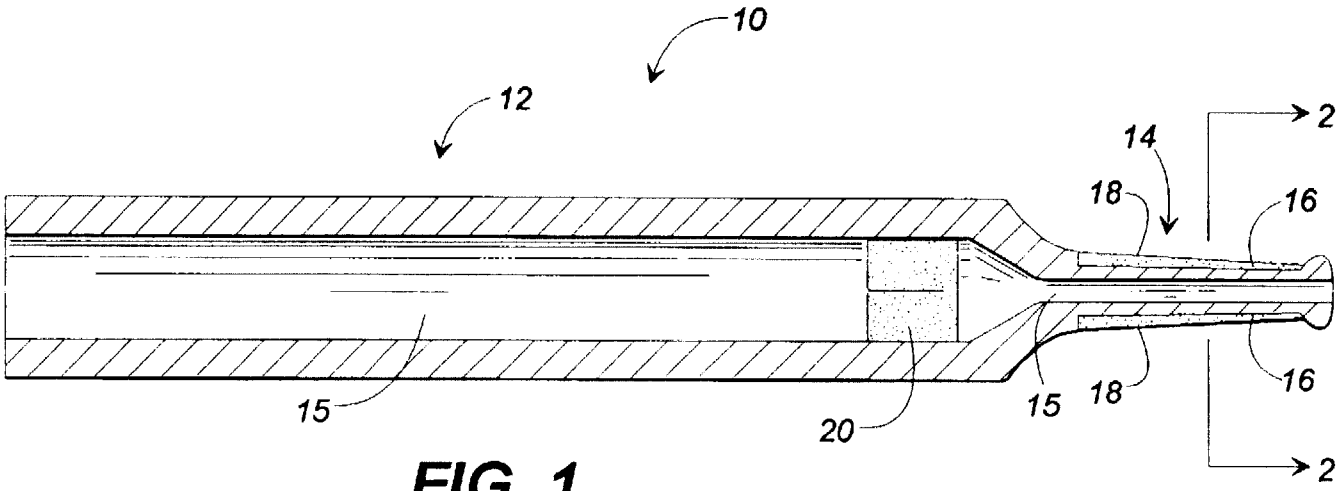
FIG. 1 is a side cross sectional view of one embodiment of a device according to the present invention.

Referring now to the drawings, FIG. 1 illustrates a basic embodiment of a device according to the present invention. The device includes a housing 10 which is made up of a hollow body section 12 and a hollow mouthpiece section 14, the hollow portions of both sections being connected with each other such that air is able to move through a hollow channel 15 formed in housing 10 in either direction from the outlet of body section 12 to the opening of mouthpiece section 14, which is preferably flared radially outward to aid the user's lips in retaining the device. Housing 10 can be made of any suitable material or materials, preferably a suitable plastic.

A device according to the present invention further includes a nicotine-containing material 16 which is located on, or is in communication with, at least one of the outer surfaces of mouthpiece section 14, in such a way that the user, through lip contact with mouthpiece section 14 and/or through the use of suction created by the user's mouth, can remove a desired amount of nicotine-containing material from the device and cause the nicotine-containing material to enter the user's mouth cavity.

Figure 2:
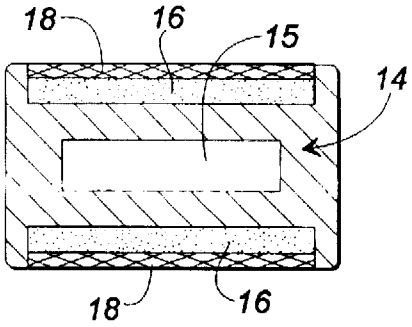
FIG. 2 is a side cross sectional view along section A—A of FIG. 1.
Figure 3:
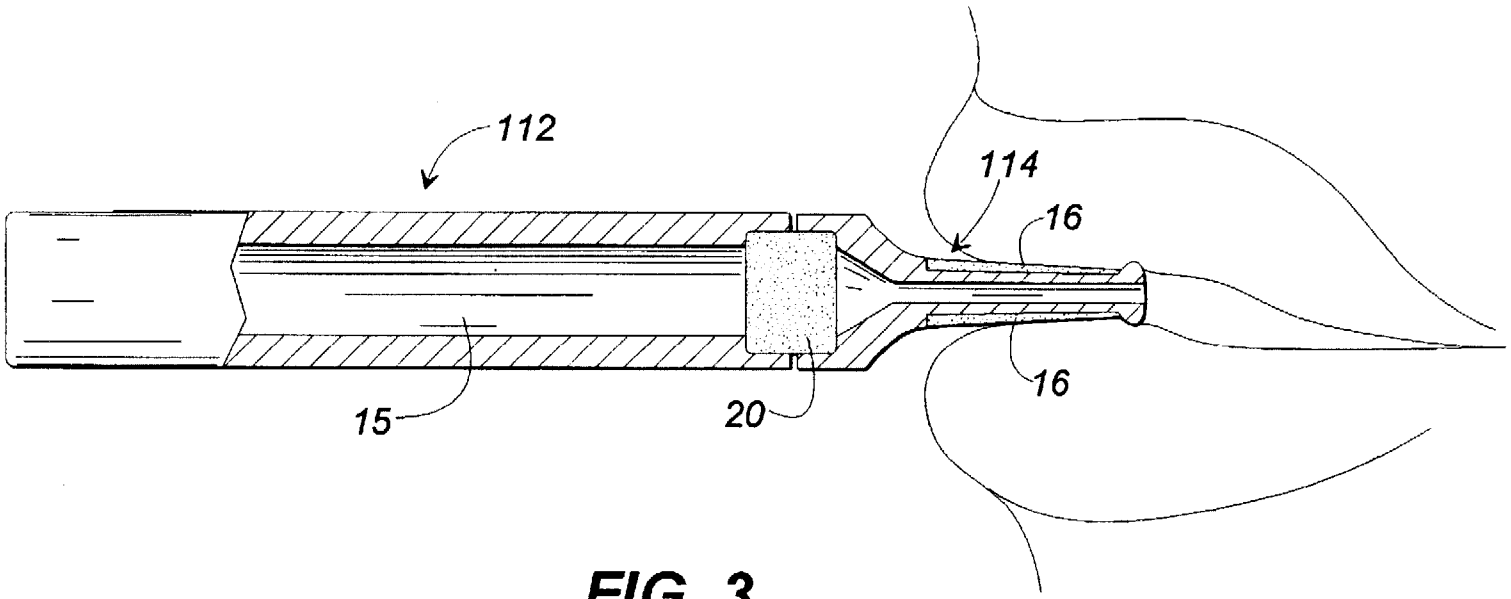
FIG. 3 is a side cross sectional view of another embodiment of a device according to the present invention as it appears when held by the lips of the user.

Preferably, nicotine-containing material 16 is in the form of a gel of suitable viscosity, which may be attractively flavored by the addition of suitable flavoring additives, and is preferably located on the upper and lower surfaces of mouthpiece section 14, as can best be seen in FIG. 2, which is an end cross section view taken along the section A—A of FIG. 1. FIG. 2 illustrates a preferred embodiment wherein nicotine-containing material 16 is overlaid with a permeable membrane 18 of suitable properties. It will be appreciated that the cross-sectional shape of mouthpiece section 14 may be of any suitable shape and preferably is somewhat curved or ellipsoid so as to be most easily accommodated by the user's lips.

In a preferred embodiment of a device according to the present invention, housing 10 includes, preferably in its hollow body section 12, flavoring means 20 for imparting flavoring, such as menthol, to air passing through said housing. Flavoring means 20 is in the form of a porous plug which is impregnated with a suitable flavoring material. Preferably, the properties of the plug, including the pressure drop across the plug during normal suction through the mouthpiece, are such as to accurately simulate the feel of a cigarette, so as to further satisfy the user's need to manipulate a cigarette-like object. As air is forced to flow through the plug and into the mouthpiece, flavoring molecules are removed from the plug and transported to the mouthpiece and into the user's mouth.

In another embodiment according to the present invention, depicted in FIGS. 3–6, the device is made up of two separate sections which are detachably connected. One section is a hollow housing 112 while the other is a hollow mouthpiece 114, detachably connected to hollow housing 112. Preferably, hollow housing 112 is reusable, while hollow mouthpiece 114 is disposable such that hollow mouthpiece 114 is discarded once the nicotine supply has been exhausted while hollow housing 112 can be removed from an exhausted mouthpiece 114 and quickly installed on a new mouthpiece 114 containing a fresh supply of nicotine.

It is to be noted that the two segment constructions of the embodiments of FIGS. 3–6 allows for the independent insertion of suitable flavoring means 20 between hollow housing 112 and hollow mouthpiece 114, which flavoring means 20 may also be utilised to effect or enhance the detachable connection between housing 112 and mouthpiece 114.

Figure 4:
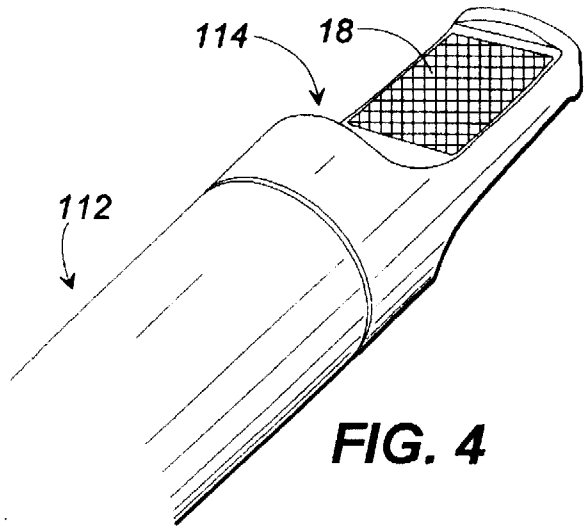
FIG. 4 is a perspective view of one embodiment of the mouthpiece portion of a device according to the present invention.
Figure 5:
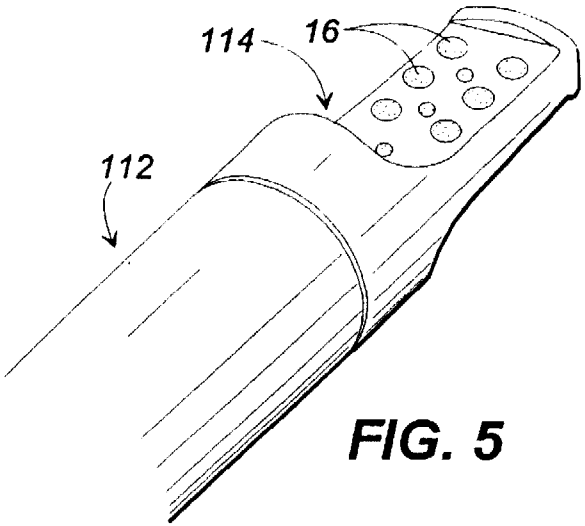
FIG. 5 is a perspective view of another embodiment of the mouthpiece portion of a device according to the present invention.

In either the monolithic structure of the embodiment of FIG. 1 or the two-section structure of the embodiments of FIGS. 3–6, nicotine-containing material 16 can be configured in a variety of ways. For example, nicotine-containing material 16 may simply fill a suitable sized and shaped depression in the surface of mouthpiece 14 or 114, as shown in FIG. 4, allowing for direct contact over a relatively large area between nicotine-containing, material 16 and the user's lips. Alternatively, nicotine-containing material 16 may be placed in a plurality of depressions, or holes, on a surface of mouthpiece 14 or 114, as shown in FIG. 5.

Figure 6:
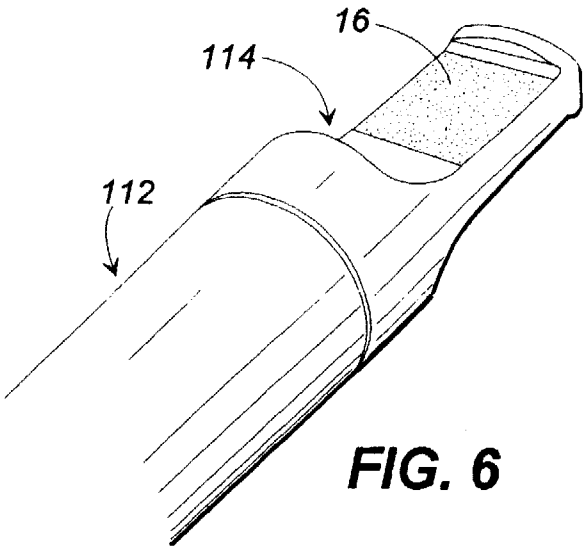
FIG. 6 is a perspective view of yet another embodiment of the mouthpiece portion of a device according to the present invention.

In a preferred embodiment shown in FIGS. 6 and 2, nicotine-containing material 16 is located between the outside surface of mouthpiece 14 or 114, preferably in a suitable depression, and a permeable membrane 18 which overlays the layer of nicotinecontaining material. The properties of permeable membrane 18 and nicotine-containing material 16 are such that the user is able to suck nicotine-containing material 16 through permeable membrane 18 at appropriate rates to maximise the user's satisfaction.

We claim:

1. A nicotine oral delivery device, comprising:

(a) a housing, said housing including a hollow body section and a hollow mouthpiece section connected with said hollow body section; and (b) a nicotine-containing material located on, or in communication with, at least one of the outer surfaces of said mouthpiece section; at least one of the outside walls of said mouthpiece section being at least partially covered by a permeable membrane and said nicotine-containing material being located between said mouthpiece section and said membrane.

2. A device as claimed in claim 1, wherein said nicotine-containing material is in the form of a gel.

3. A device as claimed in claim 1, wherein said housing further includes flavoring means for imparting flavoring to air passing through said housing.

4. A device as claimed in claim 3, wherein said flavoring means is located in said hollow body section of said housing.

5. A device as claimed in claim 3, wherein said flavoring is menthol.

6. A device as claimed in claim 1, wherein said nicotine-containing material is located directly on at least one of the outer surfaces of said mouthpiece portion.

7. A device as claimed in claim 1, wherein at least one of the outside walls of said mouthpiece section includes a plurality of depressions and wherein said nicotine-containing material is located in said depressions.

8. A nicotine oral delivery device, comprising:

(a) a hollow housing;

(b) a hollow mouthpiece detachably connected to said hollow housing; and (c) a nicotine-containing material located on, or in communication with, at least one of the outer surfaces of said mouthpiece; at least one of the outside walls of said mouthpiece section being at least partially covered by a permeable membrane and said nicotine-containing material being located between said mouthpiece section and said membrane.

9. A device as claimed in claim 8, wherein said nicotine-containing material is in the form of a gel.

10. A device as claimed in claim 8, wherein said housing further includes flavoring means for imparting flavoring to air passing through said housing.

11. A device as claimed in claim 10, wherein said flavoring is menthol.

12. A device as claimed in claim 8, wherein said nicotine-containing material is located directly on at least one of the outer surfaces of said mouthpiece portion.

13. A device as claimed in claim 8, where at least one of the outside walls of said mouthpiece section includes a plurality of depressions and wherein said nicotine-containing material is located in said depressions.

14. A device as claimed in claim 8, wherein said housing is reusable and said mouthpiece is disposable.

* * * * *